United States Patent [19]

Evans et al.

[11] Patent Number: 4,938,002

[45] Date of Patent: Jul. 3, 1990

[54] APPARATUS FOR ATTACHMENT OF A U-SHAPED METAL CLIP ABOUT THE TAIL END OF A PACKAGE MOVING ON A HORIZONTAL CONVEYOR

[75] Inventors: Alfred J. Evans; John T. Stanley, both of Raleigh, N.C.

[73] Assignee: Delaware Capital Formation, Inc., Apex, N.C.

[21] Appl. No.: 270,250

[22] Filed: Nov. 14, 1988

[51] Int. Cl.[5] ..... B65B 61/00; B23P 23/04

[52] U.S. Cl. ..... 53/138 A; 29/33.5; 29/243.56

[58] Field of Search ..... 29/33.5, 243.56, 243, 29/57; 53/138 A, 138 R, 417, 583; 140/82

[56] References Cited

U.S. PATENT DOCUMENTS

| | | | |
|---|---|---|---|
| 2,711,278 | 6/1955 | Gray | 53/583 X |
| 2,780,898 | 2/1957 | Weingart | 53/417 |
| 3,401,499 | 9/1968 | Jahnke | 29/33.5 X |
| 3,430,320 | 3/1969 | Knuppel | 29/33.5 |
| 3,913,628 | 10/1975 | Keating et al. | 53/138 A X |
| 4,083,164 | 4/1978 | Hagedorn | 29/33.5 X |
| 4,554,776 | 11/1985 | Chikatani | 53/138 A X |

*Primary Examiner*—Robert L. Spruill
*Assistant Examiner*—Linda B. Johnson
*Attorney, Agent, or Firm*—Allegretti & Witcoff, Ltd.

[57] ABSTRACT

Apparatus for the attachment of a U-shaped metal clip about the gathered open end of a package continuously transported on a horizontal moving conveyor belt. The apparatus includes a clipper mechanism which receives the tail of a package supported by the continuously moving belt. The clipper mechanism attaches a clip and then ejects the attached clip and the tail of the clipped bag.

2 Claims, 2 Drawing Sheets

APPARATUS FOR ATTACHMENT OF A U-SHAPED METAL CLIP ABOUT THE TAIL END OF A PACKAGE MOVING ON A HORIZONTAL CONVEYOR

BACKGROUND OF THE INVENTION

This invention relates to an improved mechanism for attaching a U-shaped metal clip about the tail end of a package supported on a moving horizontal conveyor.

Heretofore the assignee of applicant has made and sold an apparatus under the trade name, CLIP-A-MATIC, for closing the top of a bag transported by a horizontal conveyor with a U-shaped metal clip. The clip is fastened about the top or tail of the bag by means of a clip attachment apparatus or mechanism. The system is used for closing polyethylene bags, burlap bags, and cloth bags as well as multi-walled paper bags, netting and other flexible containers filled with a variety of products. The device comprises an endless horizontal conveyor upon which the product filled bag is supported for movement. The open end of the bag is engaged by opposed, parallel, horizontally arranged endless belts positioned above the horizontal conveyor and designed to gather the open end for feeding thereof into a clip attachment apparatus. The horizontal conveyor and endless belt thus transport the filled bag along the conveyor and into a clip attachment apparatus disposed horizontally below the endless belts and above the conveyor at a level to engage the gathered tail of the bag. The clipper mechanism includes a gate which alternately swings into and out of position in the pathway of the gathered tail and further gathers the tail of the bag and positions a clip die for attachment of a clip. The conveyor and clip attachment operations are intermittent inasmuch as the horizontal conveyor, as well as the endless belts simultaneously stop when a clip is attached to the tail of a bag. After a clip is attached to the tail, the clipper releases the clipped bag and the conveyor begins its operation once again.

In sum, the operation of the conveyor of this prior art device is intermittent. There has remained a need for a device of this general type wherein the conveyor operation is not intermittent. It is against this background that the present invention was developed.

SUMMARY OF THE INVENTION

In a principal aspect the present invention comprises an improvement in apparatus for attachment of a U-shaped metal clip about the gathered open end or tail of a package transported on a horizontally moving conveyor. The apparatus includes a pair of opposed, horizontally disposed, moving endless belts arranged to gather the open end of the bag supported on the conveyor. The apparatus further includes a clipper mechanism which is positioned with an open throat in the path of the tail or gathered material of the bag. The clipper apparatus further includes a gate which swings between a position exposing the open throat and a position closed against the open throat to define a pathway for a clip and to further gather the tail of the bag. The horizontal endless belts are arranged to release the tail just as the gate of the clipper gate closes and the clip is attached to the tail. A clip ejector plate is incorporated with the clipper and is positioned to engage the tail and the attached clip to eject the tail and the attached clip from the throat upon opening of the gate. The tail is thereby released from the clipper.

In operation, the tail is gathered and a clip is attached thereto. Subsequently the clipper package is ejected from the clipper and the package tail is carried along by the endless belts to a vacuum take away port where it is removed from the endless belts. At all times, the package or bag continues to move on the horizontal conveyor. The clipper operation thus is continuous and enables attachment of a clip as the horizontal conveyor continuously operates to move the bag. Consequently even though the clipper mechanism is substantially stationary and positioned above the horizontal conveyor, the package or bag will be continuously transported on the horizontal conveyor without intermittent stopping for attachment of a clip.

Thus it is an object of the invention to provide a mechanism which attaches a clip to the open end of a bag as that bag is continuously moved along a conveyor.

It is a further object of the invention to provide an improved clipper mechanism which includes a clip ejector plate associated therewith.

Yet a further object of the invention is to provide an economical and efficient clipper mechanism which can be used to close a significant number of units of bagged material as that material is moved continuously on a moving horizontal conveyor.

These and other obvious advantages and features of the invention will be set forth in the detailed description that follows.

BRIEF DESCRIPTION OF THE DRAWING

In the detail description which follows reference will be made to the drawing comprised of the following.

DESCRIPTION OF THE PREFERRED EMBODIMENT

Figure 1:
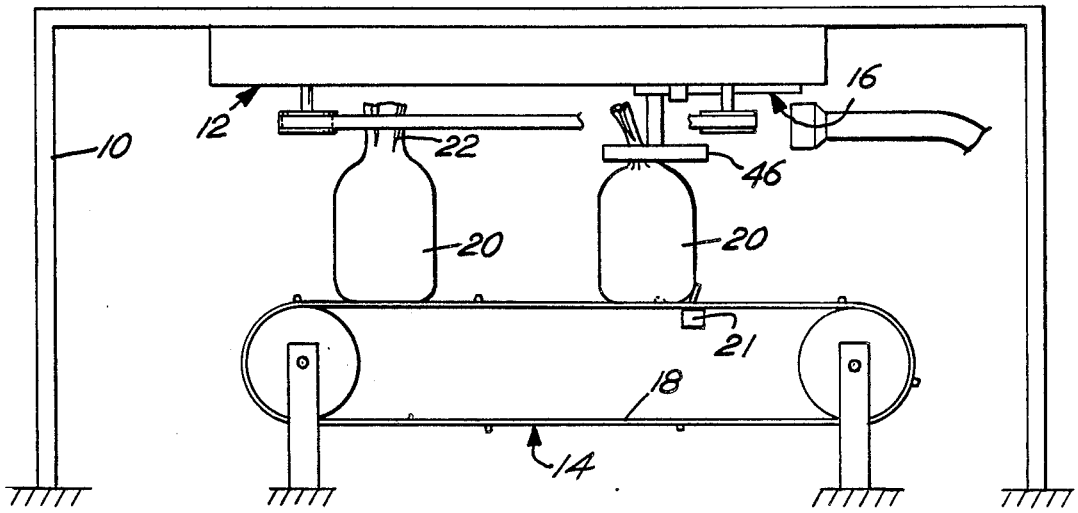
FIG. 1 is a side elevation schematic view of the improved apparatus of the present invention.

The apparatus of the present invention includes a framework 10 which supports an endless belt assembly 12 above a horizontal conveyor 14. Also supported by the framework 10 is a clipper mechanism 16. Referring to FIG. 1, the conveyor 14 includes a belt 18 which is continuously driven in a clockwise direction at an appropriate speed. The belt 18 supports a series of bags or packages 20 which are spaced one from the other after having been filled with some type of product. The bags 20 include an open top 22 which is to be fastened or clipped upon closing or gathering of the top 22. The horizontal conveyor 14 is a conventional assembly driven in a conventional fashion continuously for transport of the packages or bag 20.

Figure 2:
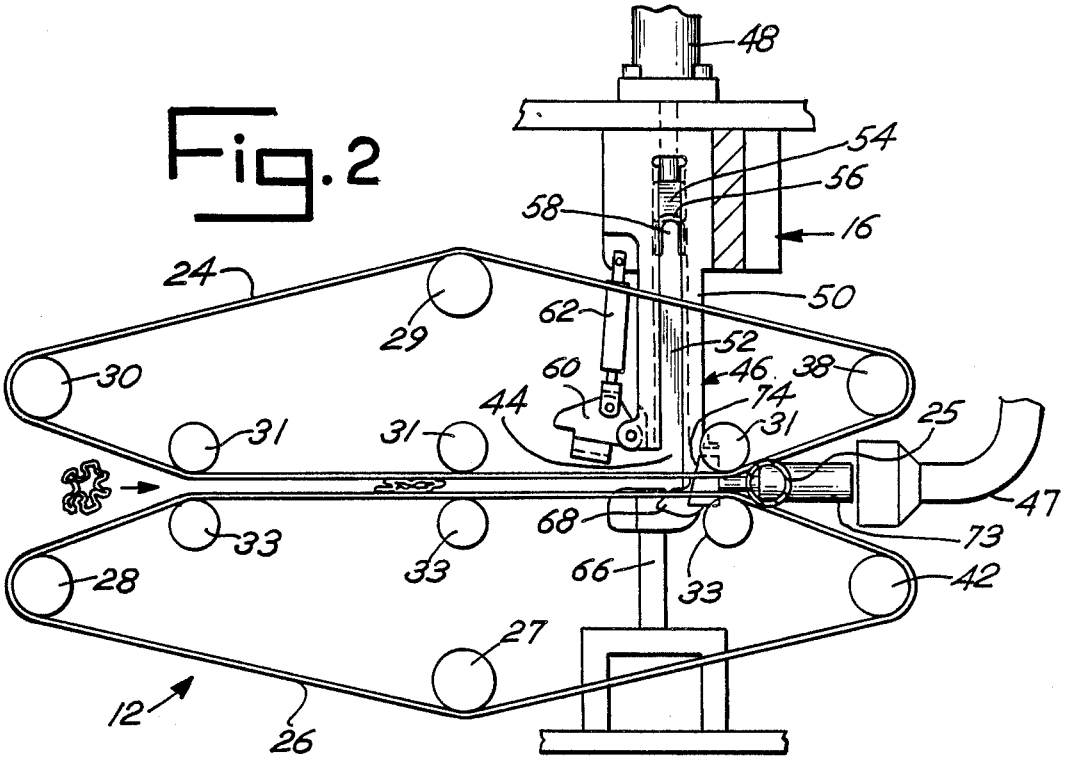
FIG. 2 is a plan sectional view of the improved apparatus of the invention illustrating the construction of the endless belts and the position of the clipper mechanism.
Figure 3:
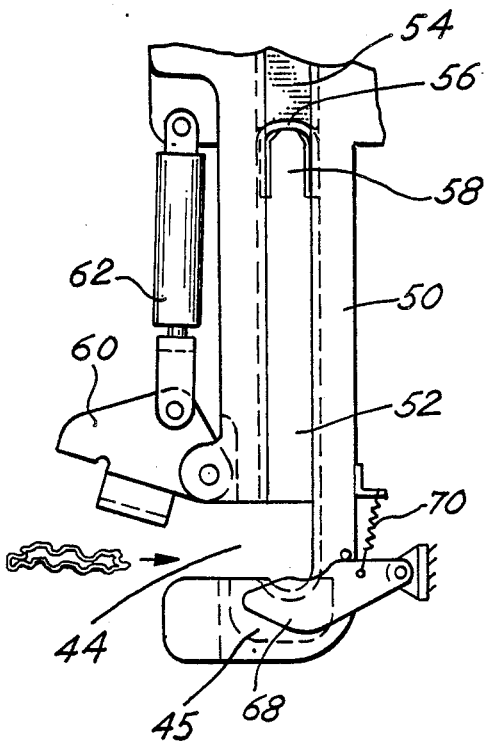
FIG. 3 is a top plan view of the clipper mechanism in the open position, positioned for receipt of the tail of a package or bag.
Figure 4:
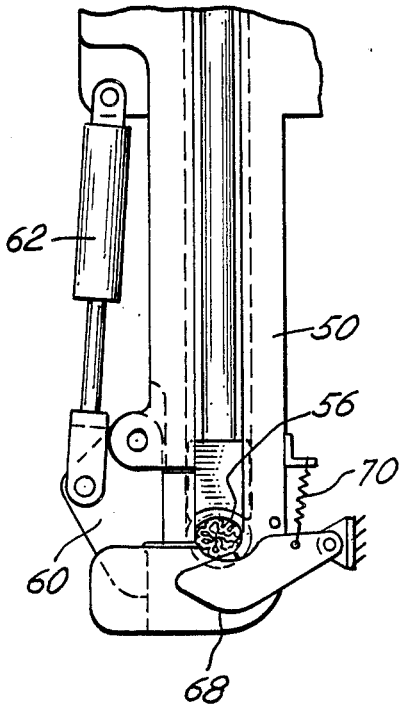
FIG. 4 is a top plan view similar to FIG. 3 wherein the clipper is in the closed position and a clip is being attached to the tail of the bag.
Figure 5:
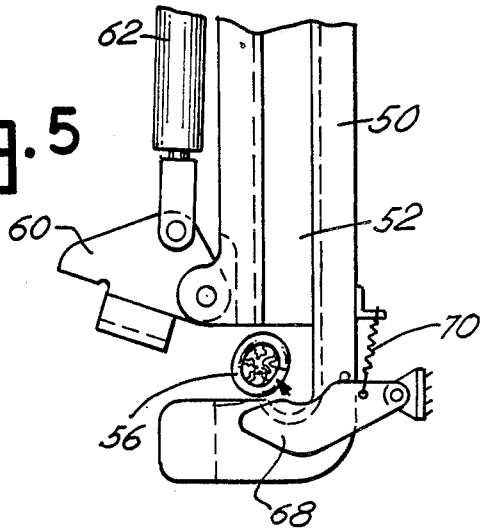
FIG. 5 is a top plan view similar to FIGS. 3 and 4 with a clip ejector plate positioned to facilitate ejection of a closed clip from the throat of the clipper mechanism.

Positioned above the horizontal belt 18 in the pathway of the packages 20 and parallel to the top run of the belt 18 is the endless belt construction or assembly 12 that is designed to receive and close the open top 22. The endless belt assembly 12 forms or compresses the sides of the open top 22 into a compact, generally elongated configuration as shown in FIG. 2. The endless belt assembly 12 includes a first endless belt 24 and an opposed second endless belt 26. Belts 24 and 26 are appropriately positioned on drive and idler rollers 28 and 30. The rollers 28 and 30 define a convergent pathway so that the open end of the bag 20 can be easily gripped between the endless belts 24 as they move cojointly in the direction indicated by the arrows in FIG. 2 to compress the open end between the belts 24 and 26. The open end 22 is thus flattened, as indicated in FIG. 2, and directed at the same speed as the conveyor belt 18 so that once a bag 20 is supported on the moving conveyor belt 18 as well as simultaneously gripped between the opposed endless belts 24 and 26, the bag 20 will move at a constant speed to the right as indicated in FIG. 1.

Referring again to FIG. 2, as the bag 20 moves to the right via belt 18, the bag 20 approaches the clipper mechanism 16. The clipper mechanism 16 is mounted in a horizontal plane below the horizontal plane defined by the endless belts 24 and 26. Mechanism 16 is positioned to intersect the tail or top 22 of bag 20.

Belts 24 and 26 maintain the tail 22 there between and transport the tail 22 into the clipper mechanism 16 as described below. There the tail 22 receives a U-shaped metal clip to seal the bag 20. A knife cuts the free end of the tail 22 above the attached clip. The free end of the tail 22 is then transported by belts 24 and 26 in the direction of movement of belt 18 and is ultimately released by belts 24 and 26 as they diverge and is carried away by a vacuum nozzle system. Upon release of the free end of tail 22 by belts 24 and 26, the free end is collected in a vacuum tube 25.

Thus each endless belt 24 and 26 has a similar construction. Belt 24 is thus retained on a series of pulleys 29, 30 and 38 which define the closed loop pathway of belt 24. One pulley 38 is driven. A series of spring biased rollers 31 tensions the belt 24 against belt 26. Similarly belt 26 is retained or mounted on pulleys 27, 28 and 42 with pulley 42 being synchronously driven with pulley 38 so that the speed of belt 26 matches that of belt 24. Idler rollers are biased against belt 26 to maintain belt 26 compressed against belt 24. Pulleys 30 and 28 are spaced relative to first idler rollers 31 and 33 to define a convergent pathway between belts 24 and 26 as shown in FIG. 2. Pulleys 38 and 42 are similarly spaced relative to the last idler rollers 31 and 33 to define a divergent pathway from belts 24 and 26 and permit release of the tail 22.

The clipper mechanism includes clipper 46 comprised of a cylinder 48 supported on a horizontal plate 50. The plate 50 defines an open throat 44, a die support 45 and includes a clip and punch channel 52 in which a punch 54 is slidably positioned to be driven by the piston in cylinder 48. The channel 52 receives a U-shaped metal clip 56 from a supply rail 58. Individual clips 56 thus are directed from rail 58 into the channel 52 to be driven by the punch 54 about gathered material and against the die 45.

Thus as a tail 22 of bag 20 enters open throat 44, a gate 60 is driven by a pivot cylinder 62 to a closed position thereby forming the remainder of the clip channel 52. The clip 56 then forms about the gathered tail 22 against die 45 in the plate 50. The plate 50 is thus supported in the horizontal position as illustrated in the FIGURES and maintained in that position by appropriate brackets such as 66.

The clipper mechanism 16 is thus maintained in a relatively rigid or fixed position generally transverse to the path defined by the endless belts 24 and 26. As soon as the tail 22 of the bag 20 is fed into the throat 44, the clip 56 is immediately attached thereto. Simultaneous with attachment of clip 56 to tail 22, a knife 74 driven by cylinder 73 cuts the tail 22 between clip 56 and belts 24 and 26. The end of tail 22 proceeds as previously described. The gate 60 is withdrawn. An ejector plate 68 operated by a spring 70 then kicks out or pushes the clip 56 from the throat 44. Inasmuch as the conveyor belt is continuously operating and moving the bag 20 forward on the conveyor as indicated in FIG. 1, the bag 20 is slightly strained during clipping and may even slide slightly on belt 18. However, as soon as clip 56 is attached and ejected by plate 68, the bag 20 settles on the conveyor belt 18 carrying forward the clipped tail 22 from throat 44.

This operation of the clipper mechanism 16 is initiated when bag 20 is sensed by a trip valve or microswitch 21 adjacent conveyor belt 18. Sensing means 22 is positioned in the throat 44, to sense the position of the tail 22 in the throat 44. Conventional control mechanisms then effect closing of the gate 60, operation of the punch 54, operation of knife 74 and operation of the ejector plate 68 in sequence.

The construction of the present invention thus differs from the prior art mechanism which provided for intermittent movement of belt 18, to feed a tail 22 into position for engagement by a clipper mechanism. That is, the prior art mechanism used a conveyor belt to support a package 20. Also, narrow opposed endless belts were used to grip onto and carry a tail between or into cooperation with a clipper. The prior art endless belts would, however, position the tail at a station for the clipper. A die and gate would then be pivoted into engagement with the tail for attachment of a clip while the entire mechanism was stopped for the attachment operation. The device thus operated intermittently since the conveyor and endless belts were required to stop while a clip was being attached to the bag. Subsequent to attachment of a clip the mechanism would again provide for movement of the gate and die of clipper mechanism out of engagement with the tail 22. The conveyors would then commence operation for removal of the package from the clipper station and for placement of a further package at the clipper station.

By contrast, with the present invention, the conveyor 18 continuously operates. The tail 22 of the package 20 is fed into the throat 44 of the clipper mechanism 16 continuously and a clip 56 is quickly attached thereto. The ejector plate 68 then "kicks out" the tail 22 from the clipper mechanism.

Thus it can be seen that an improved and more efficient continuously operated clipper mechanism is utilized with the invention as described. The invention is therefore to be limited only by the following claim and equivalents.

What is claimed is:

1. Apparatus for attachment of a U-shaped metal clip about the gathered open end of a package which is transported upon a horizontally moving, longitudinal conveyor belt with the gathered open end defining a tail extending vertically upward from the package on the belt, the apparatus being for attaching the clip in a manner which allows the conveyor to continuously transport the package in a forward direction and simultaneously attach a clip to the package, the apparatus comprising:

a clipper mechanism which gathers and affixes a clip about the gathered material of the package, said clipper mechanism including a punch and cooperative die:

generally horizontal, opposed endless belts, positioned in a horizontal plane vertically above the position of the clipper mechanism defining a longitudinal pathway for the tail which pathway is substantially parallel to the conveyor:

means for releasing the tail subsequent to the position at which the punch engages a clip against the die to form the clip about the tail end against the die:

said clipper mechanism mounted generally horizontally below the horizontal plane of the endless belts and including the punch positioned on one side of the pathway of the tail, the clipper mechanism defining a clip and punch channel mounted transverse to said feed direction and the punch slidably mounted for transverse sliding in the clip and punch channel and for driving the clip transversely in the clip and punch channel and the die positioned on the opposite side thereof so that a clip may fit over the tail:

an open throat in the clipper mechanism for receipt of the tail and positioned in the pathway to receive the tail:

a gate for defining at least a part of the clip and punch channel, said gate also for gathering the tail from behind the tail into a compact configuration in the open throat to receive a clip, said gate mounted on the clipper mechanism to swing into and out of the pathway of the tail from behind the tail:

a clip ejector plate positioned adjacent the die and moveable between a position to engage the tail subsequent to clipping and thereby drive and release a closed clip and tail from the die and thereby cause disengagement with the clipper mechanism; and means for continuously operating the conveyor and the opposed belts at all times during the clipping operation while simultaneously operating the clipper mechanism intermittently in response to positioning of a tail in the open throat.

2. The improved apparatus of claim 1 including knife means on the clipper mechanism for cutting the tail between the endless belts and a clip attached to the tail, and means for operating the knife to cut the tail substantially simultaneously with the attachment of a clip.

* * * * *